US008119947B2

(12) United States Patent
Yang

(10) Patent No.: US 8,119,947 B2
(45) Date of Patent: Feb. 21, 2012

(54) PIVOTING BARRIER FOR CONTACT ARM PROTECTION

(75) Inventor: Guang Yang, Duluth, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 438 days.

(21) Appl. No.: 12/506,018

(22) Filed: Jul. 20, 2009

(65) Prior Publication Data

US 2010/0025378 A1 Feb. 4, 2010

Related U.S. Application Data

(60) Provisional application No. 61/084,302, filed on Jul. 29, 2008.

(51) Int. Cl.
*H01H 9/30* (2006.01)

(52) U.S. Cl. ..... 218/147; 218/41

(58) Field of Classification Search ..... 218/15–21, 218/34, 40, 41, 147–149, 155; 335/201, 335/202

See application file for complete search history.

(56) References Cited

U.S. PATENT DOCUMENTS 5,608,198 A * 3/1997 Clark et al. ..... 218/147
5,780,800 A * 7/1998 Palmieri et al. ..... 218/147

* cited by examiner

*Primary Examiner* — Renee Luebke
*Assistant Examiner* — Marina Fishman

(57) ABSTRACT

A circuit breaker includes a pivoting arc barrier that is interposed between the moving contact arm axis of motion and the moving contact, so that arc gasses are deflected away from the contact arm structure. The pivoting arc barrier pivots in a complimentary motion path with that of the moving contact arm so that an arc shield face is interposed between the contact separation arc generated around the moving contact and the remaining arm structure to which the moving contact is affixed throughout the range of contact arm operational motion. The pivoting arc barrier moves independently of the moving contact arm and advantageously does not increase the contact arm mass or bulk swept volume through its range of motion.

20 Claims, 9 Drawing Sheets

PIVOTING BARRIER FOR CONTACT ARM PROTECTION

CLAIM TO PRIORITY

This application claims the benefit of co-pending U.S. provisional patent application entitled "Rotational Barrier for Contact Arm Protection" filed Jul. 29, 2008 and assigned Ser. No. 61/084,302, which is incorporated by reference herein.

BACKGROUND OF THE DISCLOSURE

1. Field of the Invention

The invention relates to circuit breaker circuit protection devices for electrical distribution systems. More particularly the present invention is directed to arc barriers within circuit breakers that may reduce potential erosion of moving contact arm and other internal circuit breaker components caused by electrical discharge arcing during circuit breaker contact separation.

2. Description of the Prior Art

Circuit breakers are utilized in electrical distribution systems to interrupt power current flow upon detection of a potential overload in the system. Generally circuit breakers are interposed in a power distribution circuit between a line source of power and a downstream circuit load. A circuit breaker commonly includes one or more fixed and moving separable contact pairs that open and close the power distribution circuit. A trip unit (often electromechanical, analog electronic or digital electronic) monitors circuit load and causes an operating mechanism to separate the contact pair (open the circuit) upon detection of an overload condition.

It is known in the art that during contact separation a current-induced arc of ionized plasma may form between the contact pair, potentially causing undesirable erosion of circuit breaker internal components, including the fixed and moving contacts as well as the moving contact arm. The electromagnetic properties of circuit breaker arcs can cause the arc to deflect toward the rotational axis of the moving contact arm during contact separation. It is desirable to shield the moving contact arm from such arc deflection.

Attempts to affix stationary shields to the circuit breaker housing would not protect the moving contact arm through its entire range of arm motion for all operational modes. Those skilled in the art appreciate that moving contact arms are often designed execute complex compound motion paths that are combinations of rotation and translation about an axis. Those complex compound motion paths often vary in different circuit breaker operating modes. By way of example, during manual operational mode, when a circuit breaker operating handle manually opens or closes the circuit breaker contacts, the operating mechanism is often designed to shift or translate the moving contact arm rotational axis along a path that intersects the motion path traversed by the breaker arm during a circuit fault interrupt contact separation that is initiated by the trip unit. Thus it is not possible to affix a stationary shield structure directly within the circuit breaker that would shield all ranges of circuit breaker arm motion: such a shield would block the circuit breaker moving contact arm motion path in one or more operational modes.

Moving contact arm shielding solutions attempted in the past have included translating the shield along the path of the contact arm in its various operational modes by (a) partially surrounding or fully enveloping the moving contact arm in a non-conductive material shield or (b) affixing sliding shields directly to the moving contact arm. Both of these prior solutions undesirably increase moving contact arm mass and potentially increase the bulk swept volume space occupied by the contact arm through its full range of motion. In attempted solution (a) the entire contact arm structure mass is increased and in attempted solution (b) the arm is forced to drag along the mass of the sliding shield. During a fault detection circuit breaker trip it is desirable to open and separate the contacts as quickly as possible in order to dissipate the arc. Any increase in contact arm inertial mass may undesirably slow contact separation speed. With respect in increase of contact arm bulk swept volume through its range of motion, there is a finite volume available within a circuit breaker housing to accommodate all components. A bulkier contact arm structure impacts surrounding and mating component potential occupied volume.

Thus, a need exists in the art for a circuit breaker apparatus that shields the moving contact arm from at least part of the arc created during contact separation through the full range of contact arm compound motion without increasing the arm's inertial mass and preferably not increasing its bulk swept volume.

SUMMARY OF THE INVENTION

Accordingly, an object of the invention is to shield a circuit breaker moving contact arm throughout its range of compound motions in different operating modes from at least part of the arc created during contact separation, but without increasing the moving contact arm mass or occupied swept volume.

These and other objects are achieved in accordance with the present invention by interposing a pivoting arc barrier between the moving contact arm axis of motion and the moving contact, so that arc gasses are deflected away from the contact arm structure. The pivoting arc barrier is not affixed to the moving contact arm in any way, so that it does not increase contact arm inertial mass. Rather, the pivoting arc barrier pivots in a complimentary motion path with that of the moving contact arm so that an arc shield face is interposed between the contact separation arcs generated around the moving contact and the remaining arm structure to which the moving contact is affixed. Additionally, the pivoting arc barrier of the present invention fits within the existing swept volume space normally occupied by the contact arm in its full range of motion, because it is interposed in formerly non-utilized space between the moving contact and the contact arm rotational axis.

The present invention features a circuit breaker including a housing; a fixed contact mounted in the housing; and a moving contact arm pivotally coupled within the housing about a first axis defining a range of motion from a closed position to an open position. A moving contact is coupled to the moving contact arm distal the first axis, for electrically conductive engagement with the fixed contact when the moving contact arm is in the closed position. An arc barrier is oriented intermediate the moving contact and first axis, pivotally coupled within the housing independent of the contact arm.

As another aspect of the present invention features a circuit breaker including a housing; a fixed contact mounted in the housing; and a moving contact arm pivotally coupled within the housing about a first axis defining a range of motion from a closed position to an open position. A moving contact is coupled to the moving contact arm distal the first axis, for electrically conductive engagement with the fixed contact when the moving contact arm is in the closed position. An arc barrier is oriented intermediate the moving contact and first axis, pivotally coupled within the housing independent of the moving contact arm. An arc shield face is defined by the arc barrier, oriented generally tangentially with respect to the moving contact throughout the range of contact arm motion. In this manner the arc face shields the moving contact arm from at least a portion of electrical arcs formed between the contacts during contact arm motion.

The present invention also features a circuit breaker having a housing and a fixed contact mounted in the housing. A moving contact arm is pivotally coupled within the housing about a first axis defining a range of motion from a closed position to an open position. A moving contact is coupled to the moving contact arm distal the first axis, for electrically conductive engagement with the fixed contact when the moving contact arm is in the closed position. An arc barrier is pivotally coupled within the housing about a second axis. An arc shield face defined by the arc barrier is in sliding engagement with the moving contact arm throughout the range of contact arm motion.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of my invention can be readily utilized in circuit breaker moving contact arm arc shielding.

Circuit Breaker Structure

Figure 1:
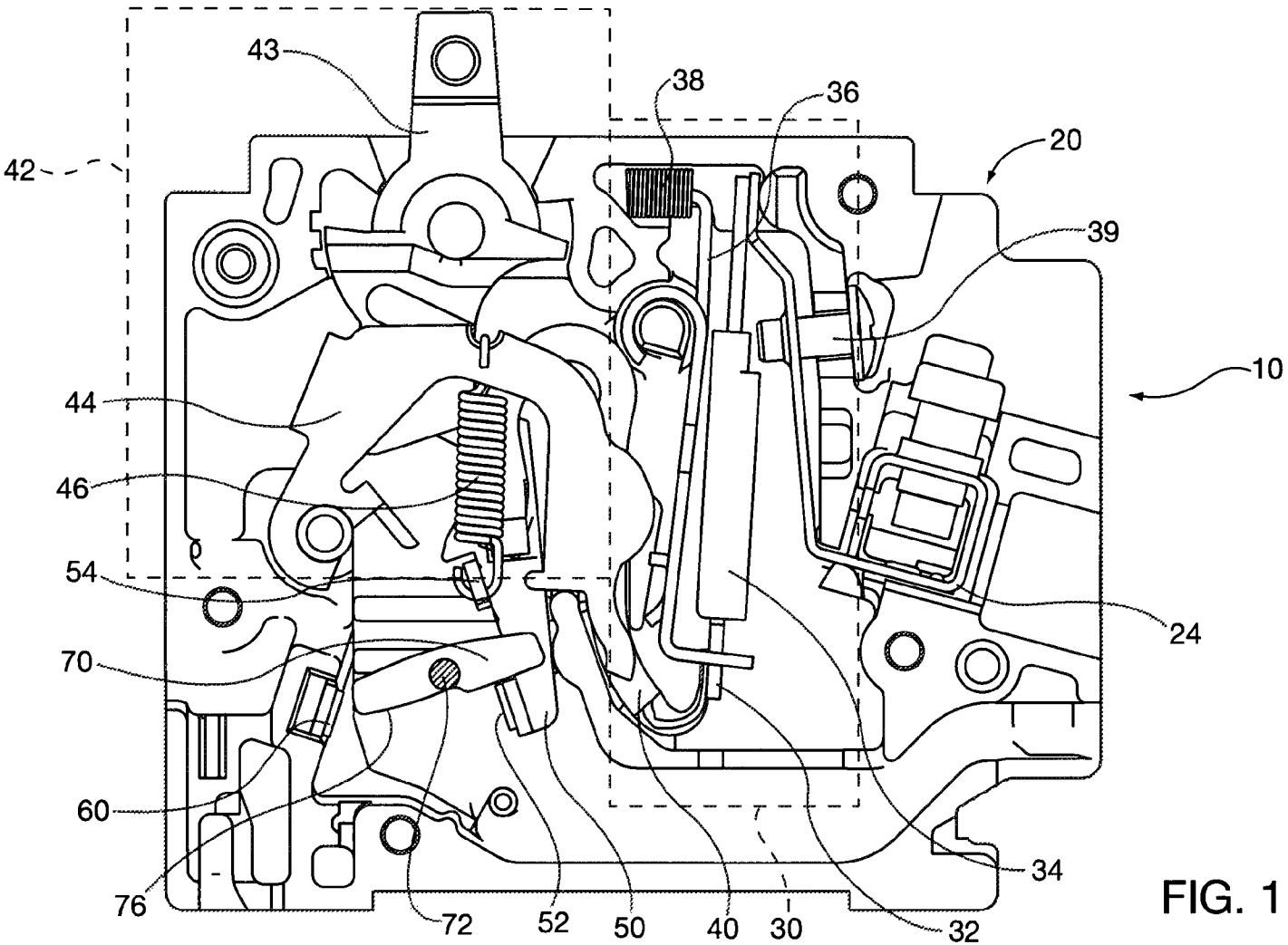
FIG. 1 is a plan view of a circuit breaker of the present invention with the circuit breaker cover removed.
Figures 2, 3:
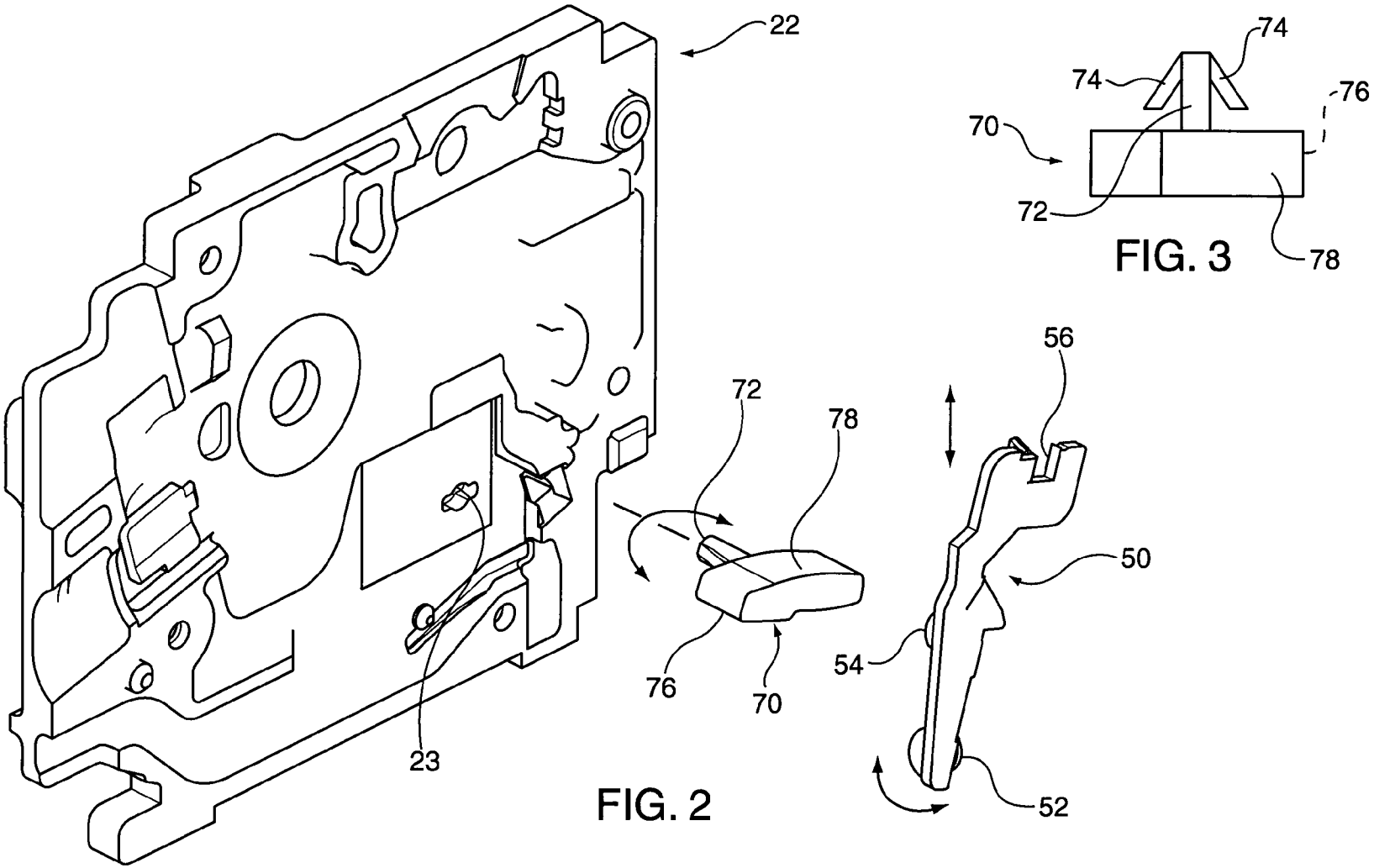
FIG. 2 is an exploded perspective view of a circuit breaker cover for the circuit breaker of FIG. 1 with the addition of the circuit breaker moving contact arm and the pivoting arc barrier.
FIG. 3 is a top plan view of the pivoting arc barrier of FIG. 2.
Figure 4:
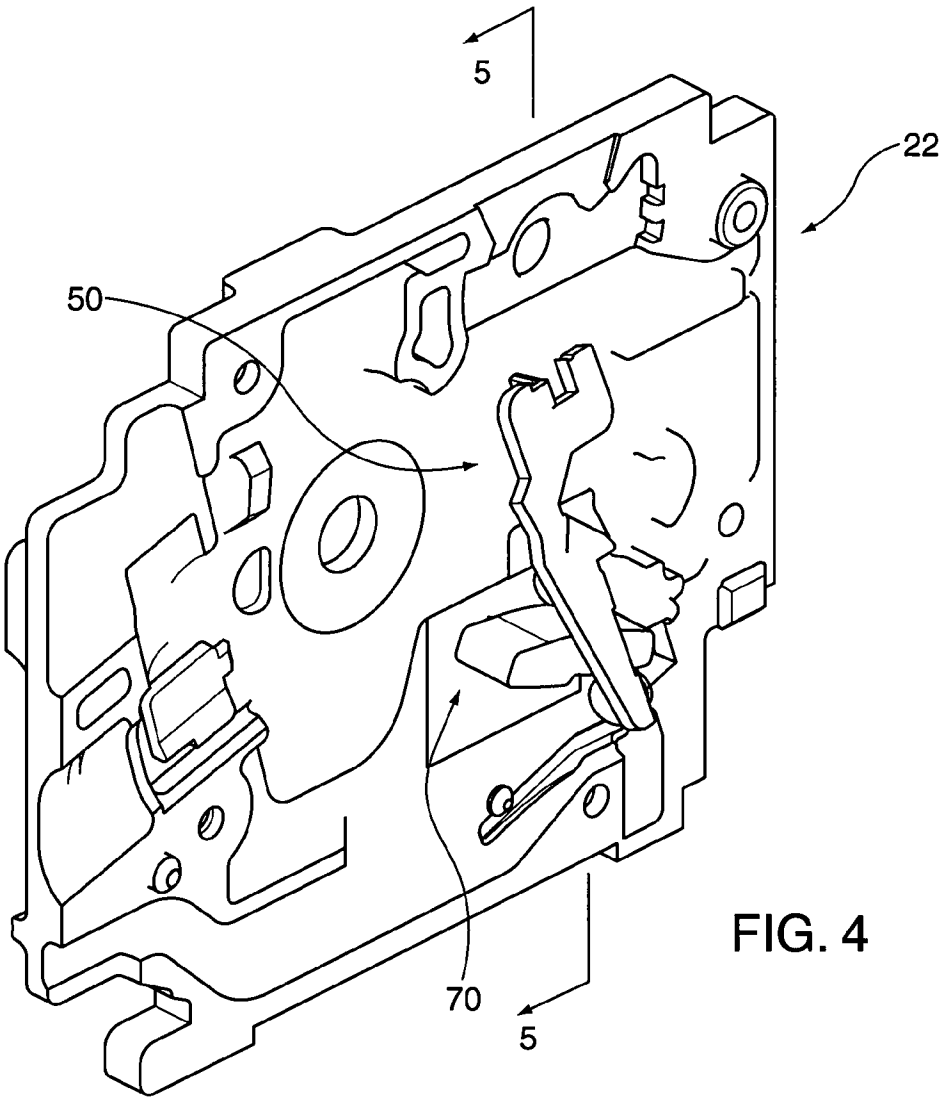
FIG. 4 is a perspective view similar to that of FIG. 2, showing the interrelationship of the moving contact arm and pivoting barrier.

Referring to FIGS. 1 and 2, circuit breaker 10 has a housing 20 and housing cover 22. The cover includes an aperture shown as keyhole slot 23. The circuit breaker 10 has a load terminal 24 electrically coupled to a trip unit assembly 30, shown in dashed lines, a flexible braid 40 electrically coupled to the trip unit assembly 30 and an operating mechanism 42, shown in dashed lines. All of these components are of known conventional design. Specifically, the trip unit 30 includes a bimetal element 32 and overcurrent protection subcomponents including a magnet 34, armature 36, armature spring 38 and bimetal calibration screw 39. The operating mechanism 42 includes conventional handle 43, cradle mechanism 44 and operating spring 46.

Figure 5:
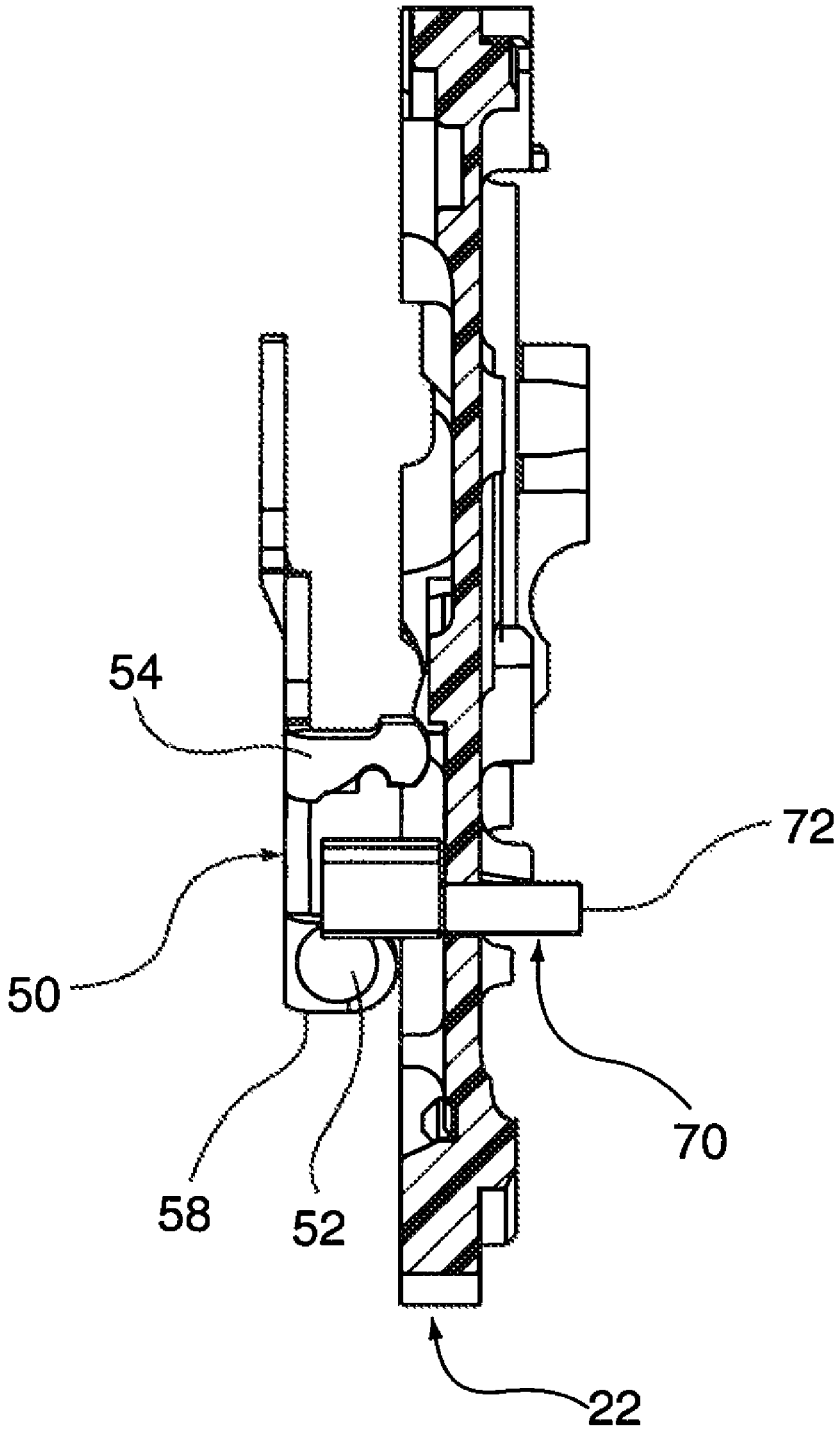
FIG. 5 is an elevational view showing the interrelationship of the moving contact arm and pivoting barrier taken along 5-5 of FIG. 4.

The circuit breaker 10 shown in FIGS. 1 and 2 also includes a moving contact arm 50 of known design that is electrically coupled to the braid 40. Referring also to FIG. 5, the contact arm 50 has a moving contact 52 and operating spring retention flange 54 that projects in a direction normal to FIG. 1 and the main web portion of the contact arm. The moving contact 52 is also affixed to moving contact mounting flange 58 in a direction normal to FIG. 1 and the main web portion of the contact arm, as is also shown in FIG. 5. The moving contact arm 50 has a slotted pivot axis 56 of known design that interacts with the cradle mechanism 44 and operating spring 46 to facilitate known compound motion of both rotation of the arm about the slotted axis 56 as well as translation of the axis along the slot in certain known operating modes of the operating mechanism 42.

The circuit breaker 10 also includes fixed contact 60 that abuts against moving contact 52 when the circuit breaker moving arm 50 is in its closed position. The fixed contact 60 is electrically coupled to a circuit breaker line stab terminal (not shown). With the contacts 52, 60 in their closed position the circuit breaker 10 is capable of conducting power from the load terminal 24 to the fixed contact 60 and line stab terminal (not shown), as in any circuit breaker. In a conventional circuit breaker, separation of the fixed and moving contacts during a circuit protection interrupt or other operating modes may cause hot arc gasses formed during contact separation to travel along the length of the moving contact arm toward its pivot axis. The additional structural features of the pivoting arc barrier of the present invention inhibit arc gas flow toward the moving contact arm.

Structure and Functional Operation of the Pivoting Arc Barrier

Referring generally to FIGS. 1-5, the pivoting arc barrier 70 of the present invention is interposed in the otherwise vacant swept volume space of the pivoting moving contact arm 50 inboard of the moving contact mounting flange 58. As shown clearly in FIG. 5, the pivoting arc barrier 70 is captured radially (with respect to the contact arm rotation axis 56) between the operating spring retention flange 54 and the moving contact mounting flange 58. The arc barrier 70, in cooperation with the moving contact arm 50 deflects the arc gasses (generated between the fixed and moving contact pair 60, 52) away from the contact arm and other operating mechanism 42 components contained within the circuit breaker housing 20. Arc gasses are deflected by arc shield face 76 that is oriented generally tangentially to the fixed and moving contacts 60, 52.

As shown in FIGS. 2 and 3, the arc barrier 70 has a pivoting axle 72 which in the exemplary embodiment shown in the figures engages within the keyhole slot 23 aperture formed within the housing cover 22. A one-way fastener, shown in the exemplary form of a so-called "Christmas tree" fastener 74, retains the arc barrier 70 as part of the cover 22 structure. While the exemplary embodiment shown in the figures shows a male pivoting axle engaged within an aperture formed within the cover, one skilled in the art may choose to pivot the arc barrier from the main housing casing base rather than the cover, or from intermediary support structure affixed to the housing. Similarly, the arc barrier 70 may incorporate female apertures while the corresponding cover or casing structure may incorporate corresponding male axles or journal shafts.

Similarly, other known one-way fasteners may be utilized to retain the pivoting arc barrier 70 within the circuit breaker 10 housing.

Figure 6:
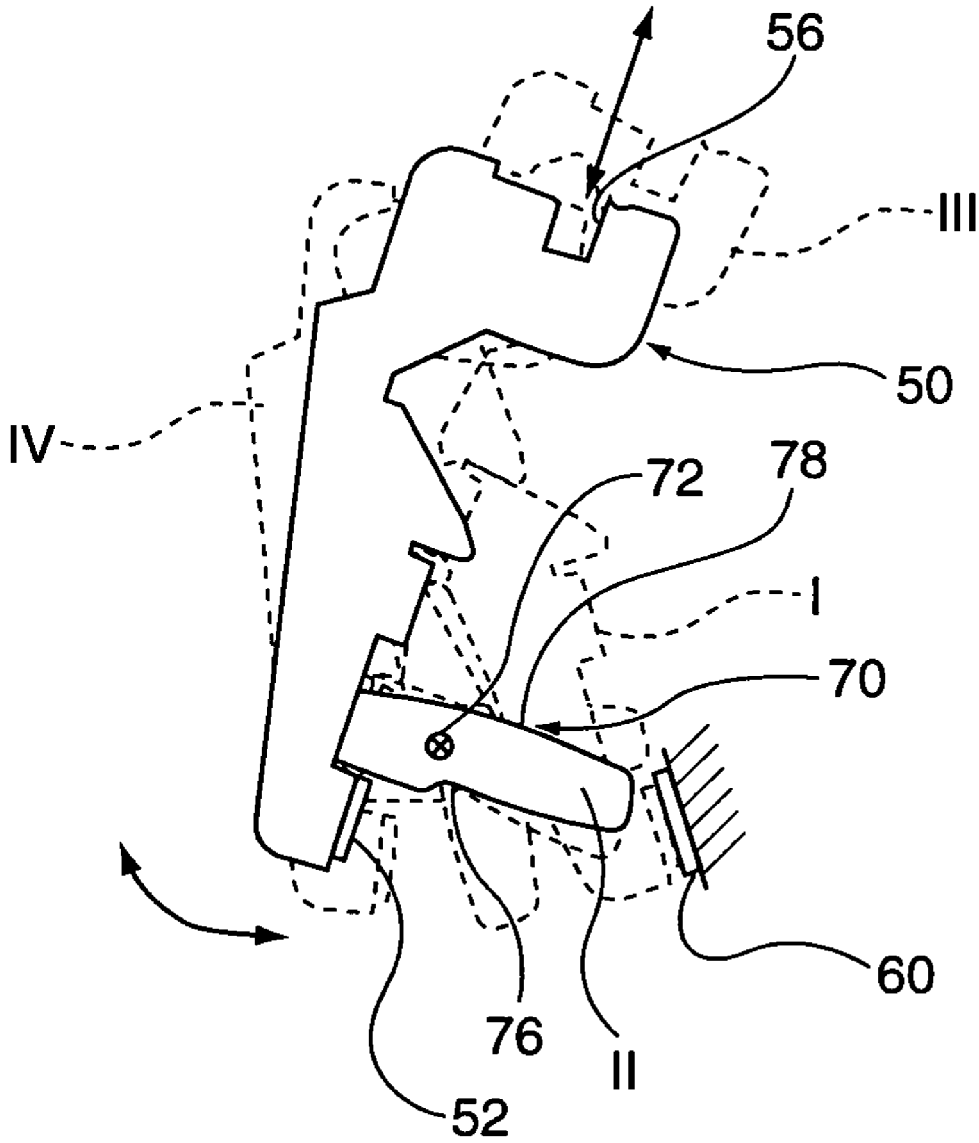
FIG. 6 is a schematic view of the relative motions of the moving contact arm and pivoting barrier in four positions, showing the full range of contact arm motion from: I contacts closed; II contacts in "tripped" position; III contacts fully open; and IV resetting the circuit breaker contact arm and operating mechanism from position III so that they may be restored to the contacts closed position I.
Figure 7:
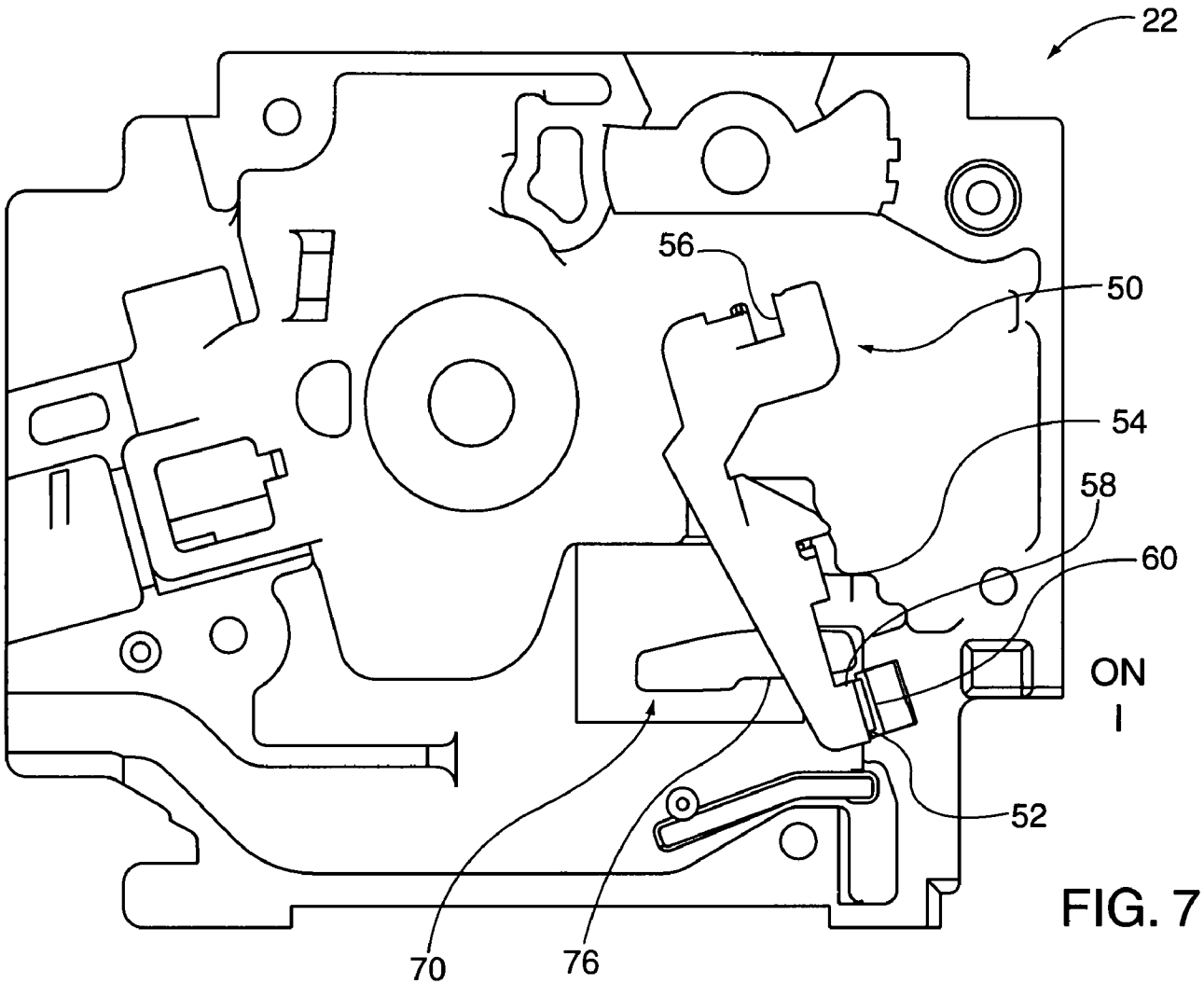
FIGS. 7-10 show the relative positions I-IV of the moving contact arm and pivoting barrier of FIG. 6 within the structural orientation of the circuit breaker cover.
Figure 8:
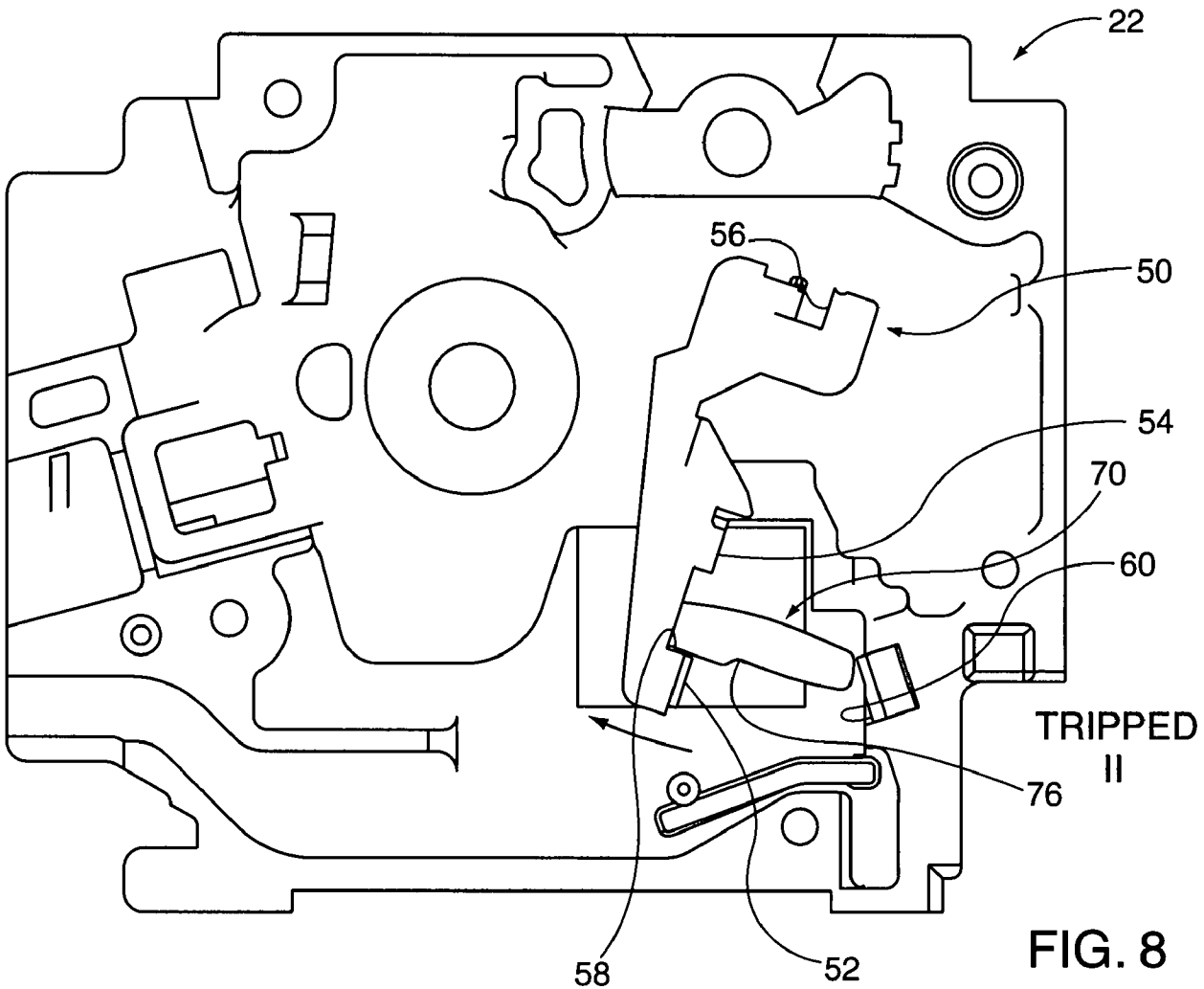
Figure 9:
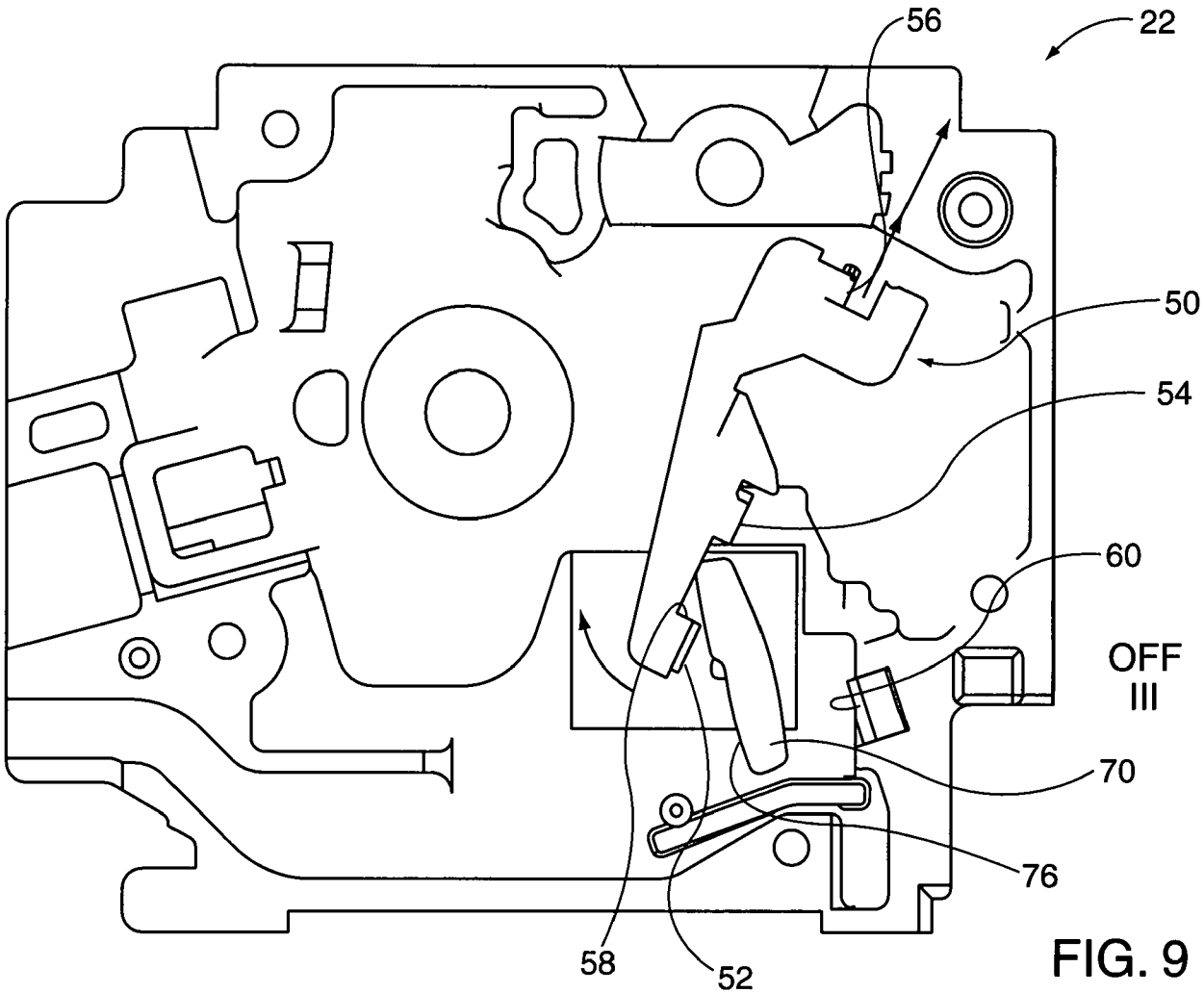

In operation, the moving contact arm 50 and the pivoting arc barrier 70 have cooperative motion paths that are shown in FIGS. 6-10. FIG. 6 is a schematic view of the relative motion paths of the moving contact arm 50 and the pivoting arc barrier 70 showing the moving and fixed contacts 52, 60 respectively in the following positions:

| | |
|---|---|
| I | Contacts closed so that the circuit breaker is capable of conducting electrical power (breaker ON). |
| II | Contacts open after the circuit breaker has tripped due to an overload condition (breaker TRIPPED). |
| III | Contacts fully opened manually through user manipulation of the circuit breaker operating mechanism and handle (breaker OFF). |
| IV | Resetting the circuit breaker contact arm and operating mechanism from position III so that they may be restored to the contacts closed position I (breaker RESET). |

Referring to schematic FIG. 6, in positions I-III the arc shield face 76 slidably abuts against the moving contact mounting flange 58 of arm 50 as the arm pivots in a clockwise rotational direction. The relative sliding abutting contact causes the contact arm 50 to tip the pivoting arc barrier about the pivoting axle 72 in a clockwise rotational direction. The only contact arm 50 force necessary to tip the pivoting barrier is a relatively small torque moment generated by the leverage along the relatively long contact arm length from the pivot axis 56 to the moving contact mounting flange 58. As one skilled in the art can appreciate, the contact arm 50 torque moment needed to tip the pivoting barrier 70 of the present invention is negligible compared to the total torque powering the arm that is generated by the cradle mechanism 44 and operating spring 46. The needed tipping torque force expended by the contact arm 50 is also less than the inertial force that would have to be expended in order to move the additional mass of a moving a prior art barrier directly affixed to or dragged by a contact arm.

Those skilled in the art with knowledge of the operational aspects of known circuit breaker operating mechanisms appreciate that in the OFF position III the moving contact arm pivoting axis 56 is translated upwardly in known toggled operating mechanisms 42 of the type shown in FIG. 1. In the OFF position the operating mechanism is toggled in a stable "rest" position. As is also known to those skilled in the art, when the contact arm moves from the ON position I to any other position (TRIPPED II or OFF III) the operating mechanism 42 must be reset in order to re-close the breaker contacts to the ON position I. In other words, the contact arm needs to be re-positioned in a counter-clockwise rotational direction to re-cock the cradle mechanism 44 and re-tension the operating spring 46.

The breaker reset is initiated through manipulation of the operating handle 43 to the ON position. This causes the moving contact arm 50 to assume position IV shown in FIG. 10. More specifically, manipulation of the operating handle 43 to its ON position re-lowers the contact arm pivot axis 56 through an over-center position IV and back to the same orientation that it was in positions II and I. When the contact arm is manipulated to position IV those skilled in the art appreciate that the toggle mechanism translates to its other stable, over-center toggled state, wherein the operating spring 46 biases the contacts 52, 60 to the closed, abutting electrically conductive state of position I.

Figure 10:
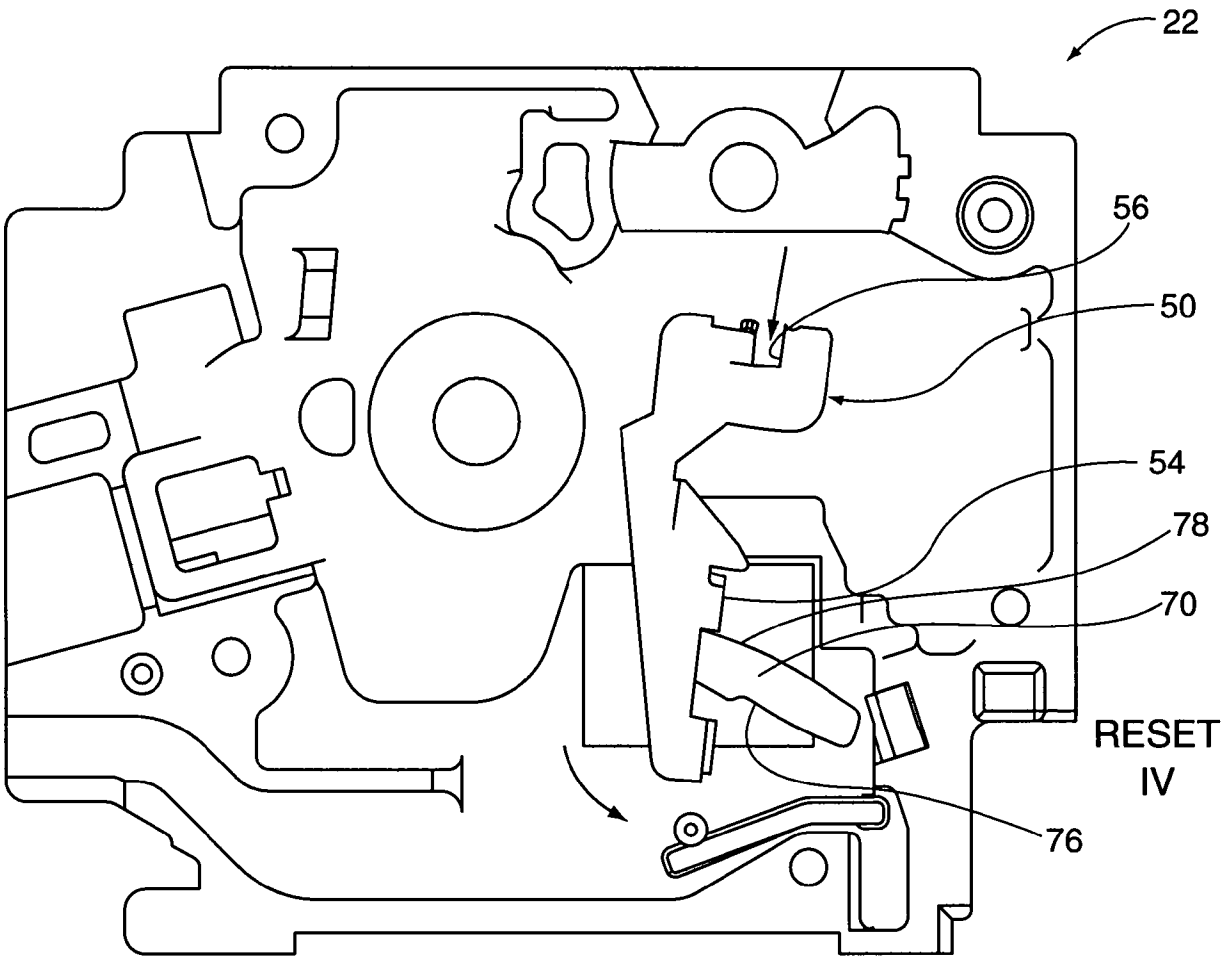

As the circuit breaker operating handle 43 is manipulated from the OFF position III to the ON position as shown in FIG. 10, the contact arm 50 rotational axis 56 is translated in a downwardly direction to that shown in position IV, and commences counter-clockwise rotation through the biasing force of the operating spring 46. As the moving contact arm 50 moves from position III to position IV the operating spring retention flange 54 abuts against the arc shield inboard face 78, thereby tipping the arc shield 70 in a counter-clockwise rotational direction, so that the shield does not inhibit or otherwise interfere with contact arm motion. The interdependent and inter-related abutting and tipping relative motions of the contact arm 50 and pivoting arc barrier 70 employ the same general mechanical motion principles throughout the range of contact arm motion and circuit breaker operating modes.

As previously discussed, the pivoting barrier 70 is restrained radially by the contact arm 50 operating spring retention flange 54 and moving contact mounting flange 58. Thus the pivoting barrier 70 cannot be over-rotated in either the clockwise or counter-clockwise rotational direction to a position that might inadvertently interfere with moving contact arm operational motion. However, if desired, rotational stops (not shown) can be inserted in the breaker housing to restrain the pivoting barrier 70 as is already done in conventional circuit breaker designs to restrain motion of the moving contact arm.

Although various embodiments which incorporate the teachings of the present invention have been shown and described in detail herein, those skilled in the art can readily devise many other varied embodiments that still incorporate these teachings.

What is claimed is:

1. A circuit breaker comprising:

a housing;

a fixed contact mounted in the housing;

a moving contact arm pivotally coupled within the housing about a first axis defining a range of motion from a closed position to an open position;

a moving contact coupled to the moving contact arm distal the first axis, for electrically conductive engagement with the fixed contact when the moving contact arm is in the closed position; and an arc barrier oriented intermediate the moving contact and first axis, pivotally coupled within the housing independent of the contact arm.

2. The circuit breaker of claim 1, wherein the moving contact is laterally offset on the moving contact arm and the arc barrier occupies at least a portion of volume swept by moving contact arm intermediate the moving contact and the first axis.

3. The circuit breaker of claim 1, wherein the moving contact arm is in abutting contact with the arc barrier throughout the range of contact arm motion.

4. The circuit breaker of claim 3, wherein the moving contact arm pivots the arc barrier throughout the range of contact arm motion.

5. The circuit breaker of claim 1, wherein the housing further comprises a cover and the arc barrier is pivotally coupled to the cover.

6. The circuit breaker of claim 5, further comprising an arc barrier axle in pivotal engagement with an aperture formed within the cover.

7. The circuit breaker of claim 5 further comprising a one-way fastener coupled to the arc barrier axle for retention of the arc barrier to the cover.

8. A circuit breaker comprising:

a housing;

a fixed contact mounted in the housing;

a moving contact arm pivotally coupled within the housing about a first axis defining a range of motion from a closed position to an open position;

a moving contact coupled to the moving contact arm distal the first axis, for electrically conductive engagement with the fixed contact when the moving contact arm is in the closed position;

an arc barrier oriented intermediate the moving contact and first axis, pivotally coupled within the housing independent of the moving contact arm; and an arc shield face defined by the arc barrier, oriented generally tangentially with respect to the moving contact throughout the range of contact arm motion, the arc face shielding the moving contact arm from at least a portion of electrical arcs formed between the contacts during contact arm motion.

9. The circuit breaker of claim 8, wherein the moving contact is laterally offset on the moving contact arm and the arc barrier occupies at least a portion of volume swept by moving contact arm intermediate the moving contact and the first axis.

10. The circuit breaker of claim 8, wherein the moving contact arm is in abutting contact with the arc barrier throughout the range of contact arm motion.

11. The circuit breaker of claim 10, wherein the moving contact arm pivots the arc barrier throughout the range of contact arm motion.

12. The circuit breaker of claim 8, wherein the housing further comprises a cover and the arc barrier is pivotally coupled to the cover.

13. The circuit breaker of claim 12 further comprising an arc barrier axle in pivotal engagement with an aperture formed within the cover.

14. The circuit breaker of claim 13 further comprising a one-way fastener coupled to the arc barrier axle for retention of the arc barrier to the cover.

15. The circuit breaker of claim 8, further comprising an arc barrier axle in pivotal engagement with an aperture formed within the housing.

16. A circuit breaker comprising:

a housing;

a fixed contact mounted in the housing;

a moving contact arm pivotally coupled within the housing about a first axis defining a range of motion from a closed position to an open position;

a moving contact coupled to the moving contact arm distal the first axis, for electrically conductive engagement with the fixed contact when the moving contact arm is in the closed position;

an arc barrier pivotally coupled within the housing about a second axis; and an arc shield face defined by the arc barrier in sliding engagement with the moving contact arm throughout the range of contact arm motion.

17. The circuit breaker of claim 16, wherein the moving contact is laterally offset on the moving contact arm and the arc barrier occupies at least a portion of volume swept by moving contact arm intermediate the moving contact and the first axis.

18. The circuit breaker of claim 16, wherein the moving contact arm pivots the arc barrier throughout the range of contact arm motion.

19. The circuit breaker of claim 16, wherein the housing further comprises a cover and the arc barrier is pivotally coupled to the cover.

20. The circuit breaker of claim 19 further comprising an arc barrier axle in pivotal engagement with an aperture formed within the cover and a one-way fastener coupled to the arc barrier axle for retention of the arc barrier to the cover.

* * * * *